US005490219A

United States Patent [19]

Badie et al.

[11] Patent Number: 5,490,219

[45] Date of Patent: Feb. 6, 1996

[54] NOISE CANCELING MICROPHONE WITH VISUAL FEEDBACK

[75] Inventors: Mehrdad Badie, Sunrise; Daniel M. Nigro, Lauderhill; Vahid Kazem-Gourdarzi, Sunrise, all of Fla.

[73] Assignee: Motorola, Inc., Schaumburg, Ill.

[21] Appl. No.: 8,245

[22] Filed: Jan. 21, 1993

Related U.S. Application Data

[63] Continuation of Ser. No. 663,534, Mar. 4, 1991, abandoned.

[51] Int. Cl.[6] ..... H04R 3/00

[52] U.S. Cl. ..... 381/122; 381/92; 381/94; 367/120; 367/122

[58] Field of Search ..... 381/92, 94, 122; 367/119, 120, 121, 122

[56] References Cited

U.S. PATENT DOCUMENTS

| | | | |
|---|---|---|---|
| 3,940,575 | 2/1976 | Bauer | 381/155 |
| 3,992,584 | 11/1976 | Dugan | 381/82 |
| 4,489,442 | 12/1984 | Anderson et al. | 381/81 |
| 4,567,608 | 1/1986 | Watson et al. | 381/122 |
| 4,817,168 | 3/1989 | Fidi | 381/168 |

*Primary Examiner*—John K. Peng
*Assistant Examiner*—Edward Lefkowitz
*Attorney, Agent, or Firm*—M. Mansour Ghomeshi

[57] ABSTRACT

Briefly, according to the invention, a noise-cancelling microphone apparatus (400) is disclosed. The microphone (400) comprises a sound transducer (106) for converting sound waves to electrical signals and means for substantially preventing ambient noise from being converted to electrical signal. A circuit (100) is provided for determining the level of noise not prevented form being converted to electrical signal. The microphone (400) further includes a display (148) for indicating when the level of the ambient noise being converted to electrical signal is above a predetermined level.

15 Claims, 3 Drawing Sheets

NOISE CANCELING MICROPHONE WITH VISUAL FEEDBACK

This is a continuation of application Ser. No. 07/663,534, filed on Mar. 4, 1991 and now abandoned.

TECHNICAL FIELD

This invention relates generally to microphones and more particularly to directional microphones.

BACKGROUND

A directional microphone utilizes front and rear porting to sense the difference between the instantaneous air pressures which impinge on its two surfaces. If an unwanted sound arrives from in front of the user, who is talking directly into front of the microphone, it will pass the rear inlet first and with a distance delay reaches the front inlet (facing the user). An internal delay at the rear inlet to the diaphragm is optimally designed to time to cancel the distance delay, thus allowing the unwanted sound to reach the diaphragm from both inlets simultaneously and therefore being cancelled. Directional microphones are becoming more widely used with portable units. In such units, an unwanted sound arriving from rear of the user is in the direction of the wanted sound and is perceived by the microphone as desired waves and is therefore processed without being cancelled. This problem is not noticed by the operator who continues to speak into the microphone. In full or half duplex systems consisting of receivers and transmitters the receiver may inform the operator of the transmitter of the poor quality of the signal being received. With this information, the operator can attempt to change his or her position hoping for improvements. With a few trials partial success may be achieved so long as the direction of the unwanted noise remains the same. With this solution being highly unpractical, it is clear that a need exists for a directional microphone that can indicate the direction of the unwanted noise. With the direction of the unwanted noise known, the operator can adjust the position of the microphone resulting in reduced noisy communications.

SUMMARY OF THE INVENTION

Briefly, according to the invention, a noise-cancelling microphone apparatus is disclosed. The microphone comprises a sound transducer for converting sound waves to electrical signals and means for substantially preventing ambient noise from being converted to electrical signal. A circuit is provided for determining the level of noise which is not prevented form being converted to electrical signal. The microphone further includes a display means for indicating when the level of the ambient noise which is converted to electrical signal is above a pre-determined level.

BRIEF DESCRIPTION OF THE DRAWINGS

FIG. 3 is a diagram of a communication device including a directional microphone in accordance with the present invention.

DETAILED DESCRIPTION OF THE PREFERRED EMBODIMENT

Figure 4:
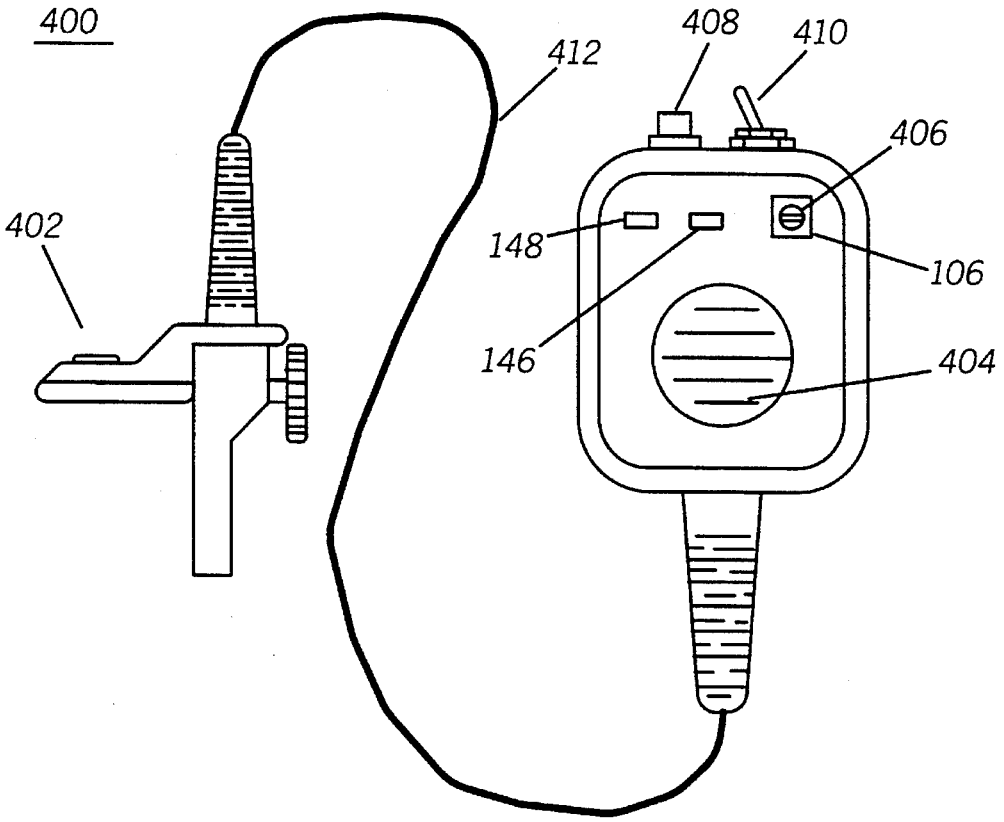
FIGS. 4 and 5 are diagrams of a directional microphone apparatus in accordance with the present invention.
Figure 5:
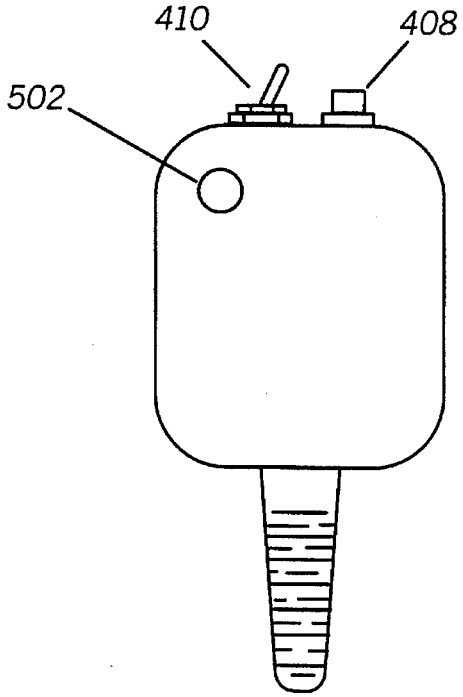

Referring first to FIGS. 4 and 5, the front and rear views of a portable microphone 400 in accordance with the present invention are shown. The microphone 400 includes a front port 406 and a rear port 502. These two ports are parts of a directional multiport transducer 106 included in the electronics of the microphone 400. The transducer 106 provides the means for substantially preventing ambient noise from being converted to electrical signals. The two ports channel the available sound waves to the transducer 106 which produces a proportional electrical signal. The available sound waves include waves from ambient noise signals. The two ports along with the directional transducer 106 work together to render the microphone 400 directional. The operation of directional microphones is well known in the art. Sound waves directed at the front port 406 are properly converted to electrical signals. However, noise waves not directed at any particular port are cancelled. An antenna connector 408 and a volume hi/low switch 410 are shown. The antenna connector 408 couples the Radio Frequency energy of a communication device attached to the microphone 400 to an antenna. A screw-on connector 402 is provided to connect the microphone 400 to a device it is meant to operate with, such as a communication device 200 of FIG. 3. The connection between the hand held microphone 400 and the connector 402 is provided via the cable 412.

Figure 1:
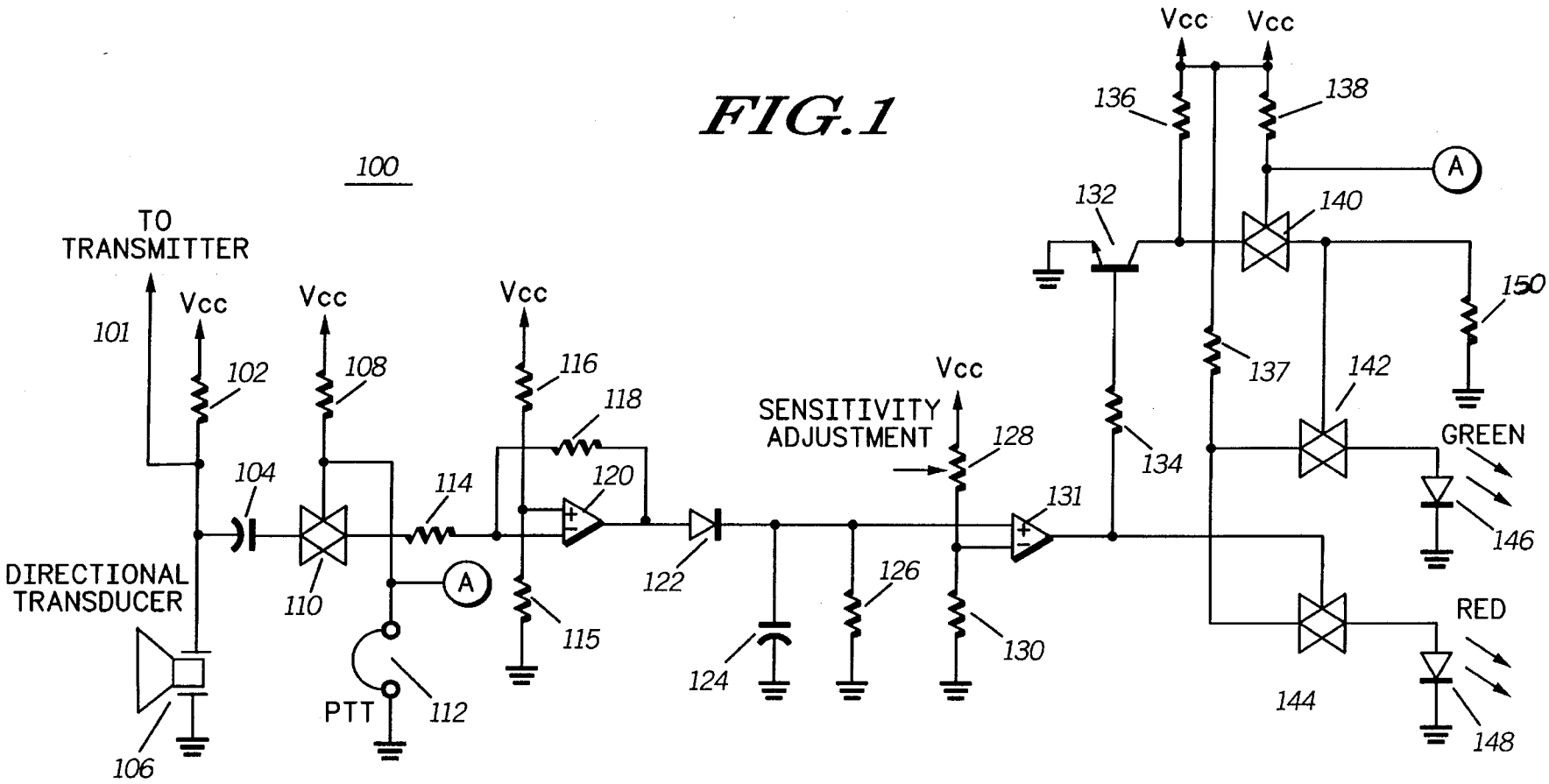
FIG. 1 is a schematic diagram of a microphone circuit in accordance with the present invention.

Referring now to FIG. 1, a schematic diagram of a microphone noise cancelling circuit 100 is shown in accordance with the present invention. The directional transducer 106 converts sound waves to electrical signals and couples them to an analog gate 110, via a capacitor 104. The transducer 106 may be a microphone element having a first and a second port operating in combination to substantially prevent noise from being converted to electrical signals. The operation of the directional transducers is well known in the art. A resistor 102 provides biasing current to the transducer 106. The control signal for the analog gate 110 is coupled to a switch 112, which is used to selectively activate the microphone 100. A resistor 108 is used as a pull up resistor for the switch 112, which produces a low in the active state. When the switch 112 is in the inactivate state, the analog gate 110 is closed coupling the input signal at pin 4 to the output pin 3. The output of the analog gate 110 is coupled to an amplifier consisting of the operational amplifier (op amp) 120 and resistors 114, 115, 116, and 118. The resistors 116 and 115 are used to set the bias point for the op amp 120. The resistor 114 is used to couple the audio signal of the analog gate 110 to the op amp 120. The resistor 118 in combination with the resistor 114 establishes the gain of the op amp 120.

The output of the operational amplifier 120 is converted to a relative DC signal via a rectifier circuit consisting of a diode 122, a capacitor 124, and a resistor 126. The relative DC signal at the cathode of the diode 122 is connected to the non-inverting input of an op amp 131 functioning as a comparator. The trip point for the comparator 131 is set via a variable resistor 128 and a fixed resistor 130. The variable resistor 128 alters the trip point of the comparator 131. In other words, the resistor 128 sets the sensitivity of the microphone apparatus 100. The variable resistor 128 may be replaced by a fixed value resistor depicting the optimum conditions. The output of the comparator 131 is applied to the base of a transistor 132 via a current limiting resistor 134 and the control input of an analog gate 144. The transistor 132 is an NPN whose emitter is grounded. The collector of the transistor 132 is connected to the control line of an analog gate 142 through another analog gate 140. The control line of the analog gate 140 is pulled up by a resistor 138 and connected to the switch 112. The inputs of analog gates 142 and 144 are connected to Vcc via a current limiting resistor 137. The outputs of the gates 142 and 144 are connected to a green LED 146 and a red LED 148 respectively. A resistor 136 connects the collector of the transistor 132 to Vcc. The control line of the analog gate 142 is pulled down by a resistor 1 50 to avoid oscillation when the analog gate 140 is in the open state.

When the switch 112 is not activated (selectively disabled), the electrical signals at the output of the transducer 106 are amplified by the op amp 120. These signals are noise at this point, as the microphone 100 is in the standby mode and no intent has been shown to transmit a signal. The amplified signal at the output of the op amp 120 is converted to DC and then compared by the comparator 131 to a pre-determined sensitivity level set via the resistor 128. The output of the comparator 131 makes a high transition if the level of the DC signal is above the pre-determined level. This high signal turns the transistor 132 on which couples ground to the control input of the analog gate 142 via the analog gate 140. Note that with the switch 112 released, the analog gate 140 is closed and therefore acting as a short circuit. The ground level at the analog gate 142 opens the connection between the Vcc and the green LED 146 shutting it off. The control line of the analog gate 144 being connected to the output of the comparator 1 31 is high. With this control line high, the analog gate 144 is closed turning the red LED 148 on via the resistor 137.

The switch 112 is used by an operator to initiate sending voice messages via a cable or a transmitter. The state when the operator is not sending any voice messages is the standby state, which occurs when the switch 112 is disabled. It is in the standby state that the noise cancelling circuit 100 analyzes the level of noise. At the moment of pressing the switch 112 the evaluation of the noise level ceases in favor of sending the operator's voice. With this switch 112 pressed the analog gates 110 and 140 are open, therefore both the green LED 146 and the red LED 148 are off. The operator views the two LEDs 146 and 148 before pressing the switch 112 to determine if the noise level is low indicated by the green LED 148. However, if the red LED 148 is lit a high level of ambient noise is being converted to electrical signal. With the red LED 148 lit, the operator changes the position of the transducer 106 or his own position to effect a change in the direction of the noise. This continues until the green LED 146 turns on indicating acceptable transmit conditions.

One of the advantages of this circuit is that it operates when the transmitter 202 is not in use. Therefore, it would have minimal effects on system throughput. Although the transmission of voice is desired to be preceded by the green LED 146 being lit, this condition is not necessary. Otherwise, no inhibition of transmission is made while the red LED 148 is lit. However, it is possible and indeed may be desirable in some systems to have a transmission inhibition feature. Although the circuit 100 is shown here with discrete components, its operation can be achieved by a processor. With many communication devices having onboard processors, the later approach may be desirable in some applications.

To summarize, the microphone circuit 100 uses the amplifier 120 and the comparator 131 to amplify and compare the noise level at the transducer 106 to a pre-determined level, set via the resistor 128. The red LED 148 turns on to indicate that the level of the ambient noise being converted to electrical signal is above the pre-determined level. The green LED 146 indicates that the ambient noise is below the pre-determined level. The operation of the circuit 100 is controlled by the switch 112 which is used to commence transmission of voice via a transmitter or a cable.

Figure 2:
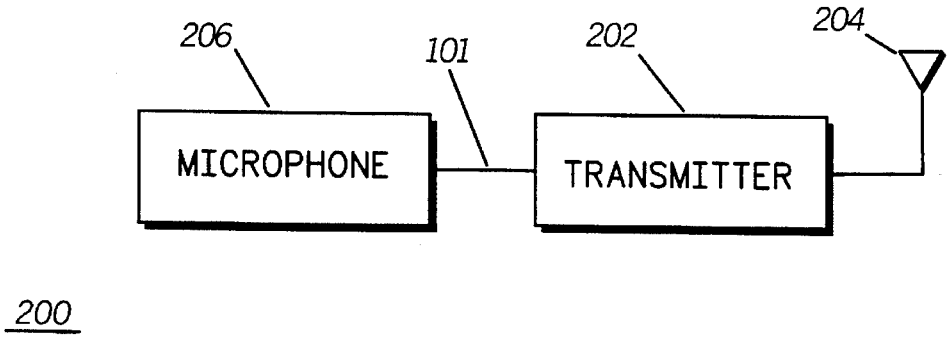
FIG. 2 is a block diagram of a transmitter in accordance with the present invention.
Figure 2:
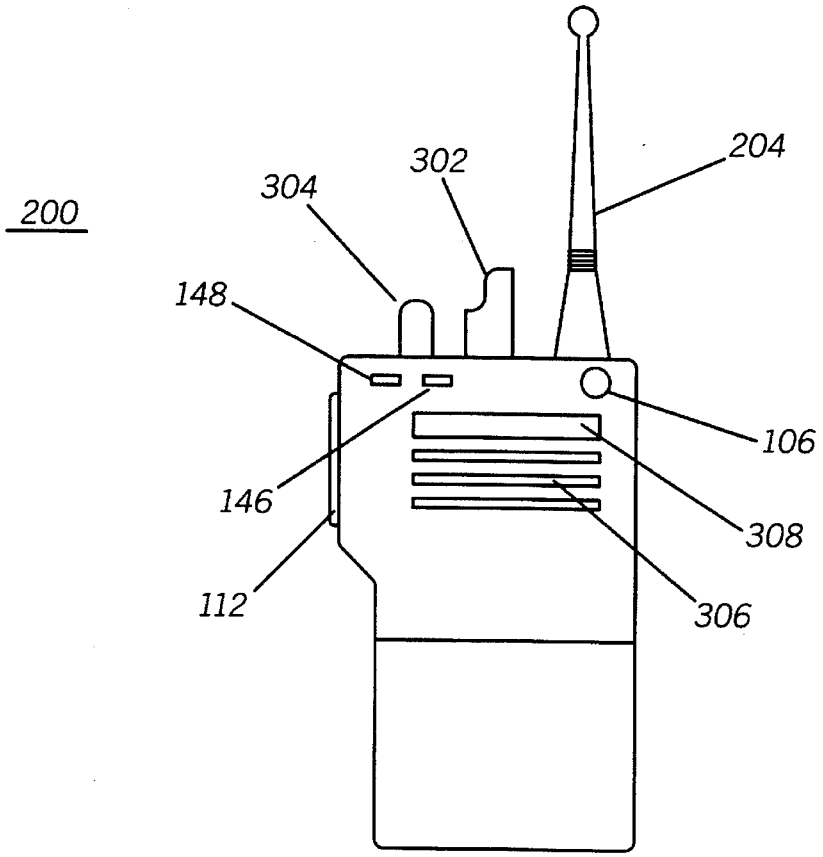

Referring to FIG. 2, a block diagram of a communication device 200 is shown in accordance with the present invention. A transmitter 202 is coupled to a microphone 206 via the microphone cable 101 ( 412 when used with the remote microphone 400). The microphone 206 includes the noise cancelling circuit 100 and may be the remote microphone 400. The transducer 106 in the circuit 100 converts voice sounds to electrical signals. The purity of these electrical signals with respect to their noise components is indicated to the operator via the red LED 146 and the red LED 148. The audio signals from the microphone 206 are routed to the transmitter 202 for transmission via an antenna 204. The microphone 206 may be attached to a person's clothing or be a part of a communication device.

Referring now to FIG. 3, the communication device 200 is shown. The microphone element 106 is used to convert the sound waves to electrical signals suitable for transmission via the onboard transmitter 202 and the antenna 204. The green LED 146 and the red LED 148 are shown on the top of the communication device for convenient observation. The communication device 200 includes receiver circuits for receiving communication signals. A speaker 306 and a volume control 304 present and control the level of the received signal, respectively. The switch 112 is shown as the Push-To-Talk (PTT) switch. The PTT switch 112 is used to inform the transmitter 202 that a transmission is being requested therefore preventing the circuit 100 from evaluating the level of the ambient noise.

The communication device 200 is normally in the standby mode. Upon receiving a signal the mode changes to receive and the operator receives voice signals on the speaker 306. The volume can be adjusted via the volume control 304. Before the operator begins to speak into the microphone, he is instructed to observe the two LEDs 146 and 148. The operator proceeds to transmit if the green LED 146 is lit. However, if the red LED is lit, the operator needs to change the position of the communication device 200 or his own position to find a more suitable noise cancelling position for the transducer 106 indicated by the green LED 146 turning on. This indicates to the operator that the direction of the noise is such that it is being cancelled by the directional microphone element 106.

The communication device 200 may include circuits that optionally inhibits signal transmission until the green LED 146 is lit. This is intended to prevent inadvertent noisy transmissions. A timer controlled by the operator may be used to limit the inhibition time.

Although the preferred embodiment employs two LEDs 146 and 148 it is possible to use only one LED to indicate the inhibition of transmission. With this LED off the operator proceeds to make a transmission, while with it being lit the operator is instructed not to transmit due to the high level of noise being converted to electrical signals. Furthermore, in some applications, the two LEDs 146 and 148 may be replaced by a more articulate display 308 such as one utilizing bar LCD to continuously indicate the best possible position of the transducer 106. With such articulate display means an operator can find the most optimum position rather than just searching for an acceptable position. Communication devices having displays for other purposes are optimum candidates for this kind of display articulation.

To summarize, as is known, the operation of a directional microphone depends on the direction of the noise reaching it. Noise reaching the back of the microphone (from the front of the operator) is optimally canceled. Noise arriving at the microphone from other directions may be cancelled, however not optimally. Noise generally reaches the microphone from several directions. This is due to the noise having various sources and/or being reflected by the surrounding walls and/or obstacles. For this reason the operator wouldn't normally know the direction of noise and hence the level of noise interfering with the transmission of his voice. With this invention an indication of the level of noise having the potential of being transmitted is provided to the operator via the LEDs 146 and 148. Hence the operator observes the LEDs 146 and 148 before commencing any transmissions. With the red LED 148 lit the operator changes the position of the device 200 or his own position until the green LED 146 lights up. The green LED 146 indicates the level of noise being processed as voice is acceptable for transmission. With this indication the operator proceeds to transmit his signal.

Communication of voice signals in noisy environments has always plagued the operators of communication devices. The use of directional microphones has helped with these situations greatly. Directional microphones cancel the ambient noise that reach the microphone element and have the opposite direction of the voice sounds. However, with the direction of noise known, portions of it that are reflected by the surrounding objects will successfully be converted to electrical signals by the microphone. Consequently, the operator has no idea of the level of noise interfering with his transmitted voice. This invention eliminates the guess work and helps the operator in making a clear transmission. With the use of indicator LEDs 146 and 148, the operator is informed of the level of noise having the potential of being mistaken for voice. With this information, the operator makes a positional adjustment until the green LED 146 is lit. This indicates that level of noise converted to electrical signal has been reduced to acceptable levels.

What is claimed is:

1. A directional microphone, comprising:

transducer means for converting sound waves to electrical signals, said transducer means having means for substantially preventing ambient noise from being converted to electrical signals;

means for determining the level of the ambient noise not prevented from being converted to electrical signal; and indicator means for indicating when the level of the ambient noise being converted to electrical signal is above a pre-determined level.

2. The directional microphone of claim 1, further including means for selectively disabling the indicator means.

3. The directional microphone of claim 1, wherein the transducer means includes a multi-port transducer.

4. The directional microphone of claim 1, wherein the indicator means comprises a Light Emitting Diode (LED).

5. The directional microphone of claim 4, wherein the LED comprises a green and a red LED.

6. The directional microphone of claim 1, wherein the indicator means comprises a Liquid Crystal Display (LCD).

7. A portable microphone apparatus:

a microphone element for converting sound waves to electrical signals, the microphone element having a first and a second port operating in combination to substantially prevent the ambient noise from being converted to electrical signals;

means for determining the level of the ambient noise being treated as sound waves and being converted to electrical signals;

comparison means for comparing the level of the ambient noise being converted to electrical signal to a predetermined level; and display means for displaying the result of the comparison means.

8. The directional microphone of claim 7 wherein the microphone element comprises a directional transducer.

9. The directional microphone of claim 7, further including:

means for selectively disabling the display means.

10. A communication device, comprising:

transmitter means for transmitting a signal;

microphone means coupled to the transmitter means for converting sound waves to electrical signals, the microphone means including:

transducer means for directionally converting sound waves, including noise, to electrical signals, the electrical signals having a purity level depending on their noise components;

means for sensing when the noise components of the electrical signals are above a pre-determined level; and means for visually displaying the level of the noise components in the electrical signal.

11. The directional microphone of claim 10, further including:

means for selectively disabling the means for displaying the level of the ambient noise.

12. The communication device of claim 10, wherein the transducer means includes a directional transducer.

13. The communication device of claim 10, wherein the means for evaluating includes a comparator.

14. The communication device of claim 10, wherein the means for visually indicating comprises an LED.

15. The noise cancelling microphone of claim 10, wherein the means for visually indicating comprises a red and a green LED.

* * * * *